US006467105B1

(12) United States Patent
Vanden Elzen

(10) Patent No.: US 6,467,105 B1
(45) Date of Patent: Oct. 22, 2002

(54) DRAIN STOPPER TO SOAK FEET IN A TUB AND SHOWER

(76) Inventor: Edward C. Vanden Elzen, 1107 Robin St., Depere, WI (US) 54115

( * ) Notice: Subject to any disclaimer, the term of this patent is extended or adjusted under 35 U.S.C. 154(b) by 0 days.

(21) Appl. No.: 09/797,660

(22) Filed: Mar. 5, 2001

(51) Int. Cl.[7] ..... E03C 1/24
(52) U.S. Cl. ..... 4/680; 4/292
(58) Field of Search ..... 4/651, 680, 687, 4/292

(56) References Cited

U.S. PATENT DOCUMENTS 458,997 A * 9/1891 Clifford ..... 4/687 X
2,065,347 A * 12/1936 Schulse ..... 4/654
2,266,043 A * 12/1941 Hutchins ..... 4/680 X
2,440,165 A * 4/1948 Behrend ..... 4/292 X
2,560,954 A * 7/1951 Jackson ..... 4/680

* cited by examiner

*Primary Examiner*—Charles E. Phillips

(57) ABSTRACT

A drain stopper to soak feet in a tub and shower for soaking one's feet while taking a shower. The drain stopper to soak feet in a tub and shower includes a main tubular member having open top and bottom ends and a bore extending therethrough for removably mounting upon a drain of a tub and shower; and also includes an annular flange member securely attached at the bottom end of the main tubular member for plugging the drain about a perimeter of the main tubular member; and further includes a sieve member removably disposed in the bore of the main tubular member to effectively screen out particulate matter.

1 Claim, 3 Drawing Sheets

FIG. 3
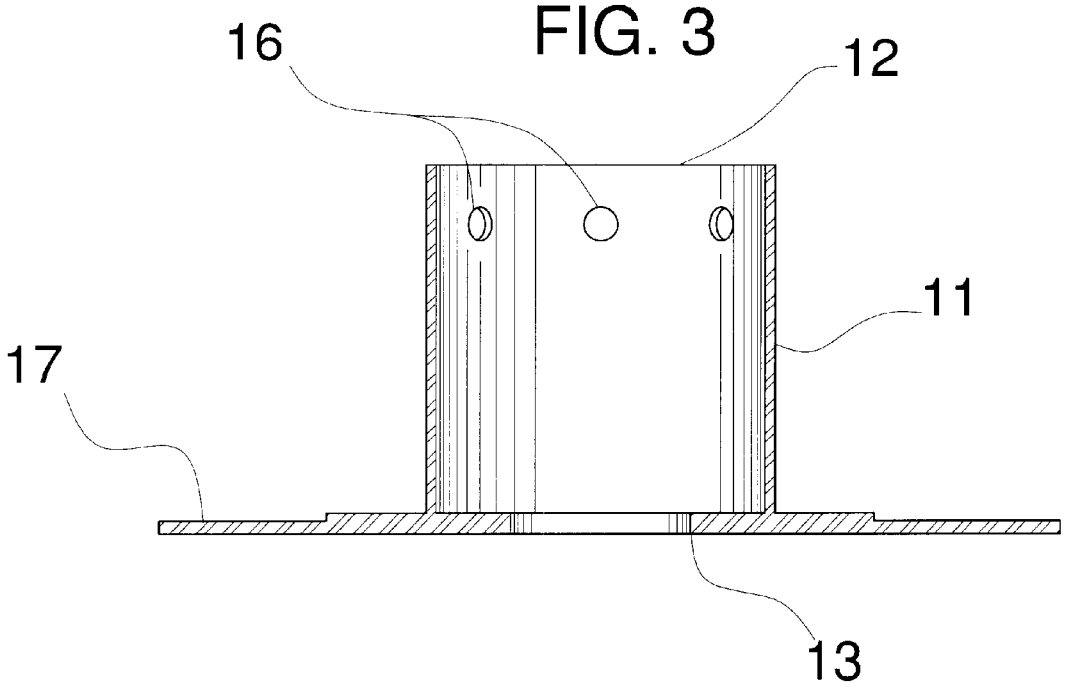
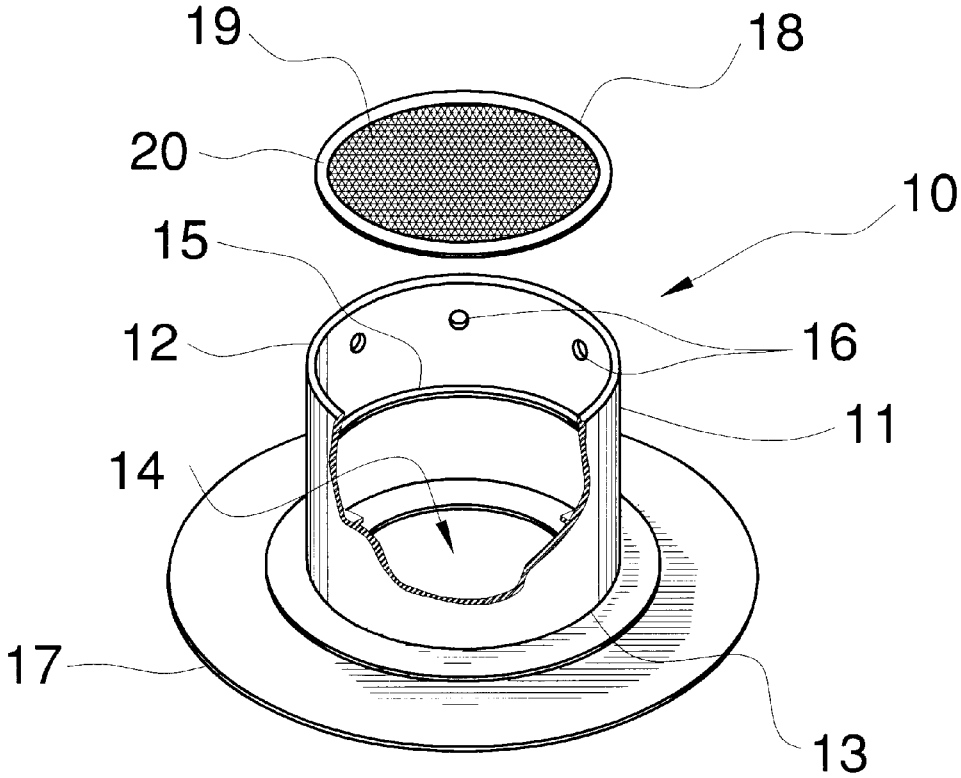
FIG. 4

DRAIN STOPPER TO SOAK FEET IN A TUB AND SHOWER

BACKGROUND OF THE INVENTION

1. Field of the Invention

The present invention relates to a tub and shower foot soaker and more particularly pertains to a new drain stopper to soak feet in a tub and shower for soaking one's feet while taking a shower.

2. Description of the Prior Art

The use of a tub and shower foot soaker is known in the prior art. More specifically, a tub and shower foot soaker heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,806,241; 4,217,667; 2,266,043; 2,394,094; 5,771,507; and U.S. Pat. No. Des. 305,455.

While these devices fulfill their respective, particular objectives and requirements, the aforementioned patents do not disclose a new drain stopper to soak feet in a tub and shower. The inventive device includes a main tubular member having open top and bottom ends and a bore extending therethrough for removably mounting upon a drain of a tub and shower; and also includes an annular flange member securely attached at the bottom end of the main tubular member for plugging the drain about a perimeter of the main tubular member; and further includes a sieve member removably disposed in the bore of the main tubular member to effectively screen out particulate matter.

In these respects, the drain stopper to soak feet in a tub and shower according to the present invention substantially departs from the conventional concepts and designs of the prior art, and in so doing provides an apparatus primarily developed for the purpose of soaking one's feet while taking a shower.

SUMMARY OF THE INVENTION

In view of the foregoing disadvantages inherent in the known types of tub and shower foot soaker now present in the prior art, the present invention provides a new drain stopper to soak feet in a tub and shower construction wherein the same can be utilized for soaking one's feet while taking a shower.

The general purpose of the present invention, which will be described subsequently in greater detail, is to provide a new drain stopper to soak feet in a tub and shower which has many of the advantages of the tub and shower foot soaker mentioned heretofore and many novel features that result in a new drain stopper to soak feet in a tub and shower which is not anticipated, rendered obvious, suggested, or even implied by any of the prior art tub and shower foot soaker, either alone or in any combination thereof.

To attain this, the present invention generally comprises a main tubular member having open top and bottom ends and a bore extending therethrough for removably mounting upon a drain of a tub and shower; and also includes an annular flange member securely attached at the bottom end of the main tubular member for plugging the drain about a perimeter of the main tubular member; and further includes a sieve member removably disposed in the bore of the main tubular member to effectively screen out particulate matter.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new drain stopper to soak feet in a tub and shower which has many of the advantages of the tub and shower foot soaker mentioned heretofore and many novel features that result in a new drain stopper to soak feet in a tub and shower which is not anticipated, rendered obvious, suggested, or even implied by any of the prior art tub and shower foot soaker, either alone or in any combination thereof.

It is another object of the present invention to provide a new drain stopper to soak feet in a tub and shower which may be easily and efficiently manufactured and marketed.

It is a further object of the present invention to provide a new drain stopper to soak feet in a tub and shower which is of a durable and reliable construction.

An even further object of the present invention is to provide a new drain stopper to soak feet in a tub and shower which is susceptible of a low cost of manufacture with regard to both materials and labor, and which accordingly is then susceptible of low prices of sale to the consuming public, thereby making such drain stopper to soak feet in a tub and shower economically available to the buying public.

Still yet another object of the present invention is to provide a new drain stopper to soak feet in a tub and shower which provides in the apparatuses and methods of the prior art some of the advantages thereof, while simultaneously overcoming some of the disadvantages normally associated therewith.

Still another object of the present invention is to provide a new drain stopper to soak feet in a tub and shower for soaking one's feet while taking a shower.

Yet another object of the present invention is to provide a new drain stopper to soak feet in a tub and shower which includes a main tubular member having open top and bottom ends and a bore extending therethrough for removably mounting upon a drain of a tub and shower; and also includes an annular flange member securely attached at the bottom end of the main tubular member for plugging the drain about a perimeter of the main tubular member; and further includes a sieve member removably disposed in the bore of the main tubular member to effectively screen out particulate matter.

Still yet another object of the present invention is to provide a new drain stopper to soak feet in a tub and shower that softens the calluses and toenails of the user while showering.

Even still another object of the present invention is to provide a new drain stopper to soak feet in a tub and shower that soothes one's feet while taking a shower.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevational view of the present invention.

FIG. 4 is an exploded top perspective view of the present invention.

DESCRIPTION OF THE PREFERRED EMBODIMENT

Figure 1:
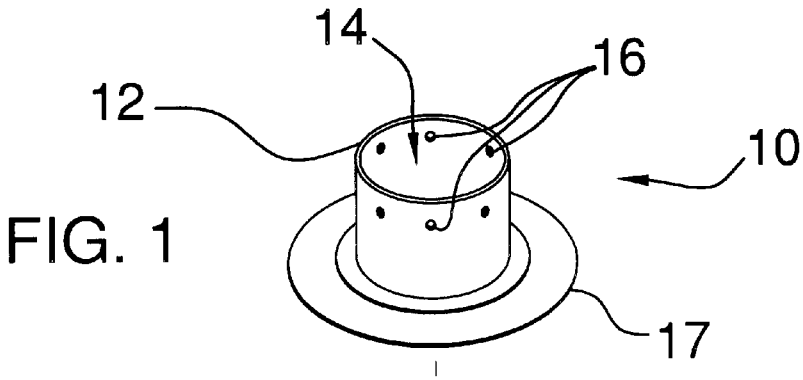
FIG. 1 is a perspective view of a new drain stopper to soak feet in a tub and shower according to the present invention shown in use.
Figure 2:
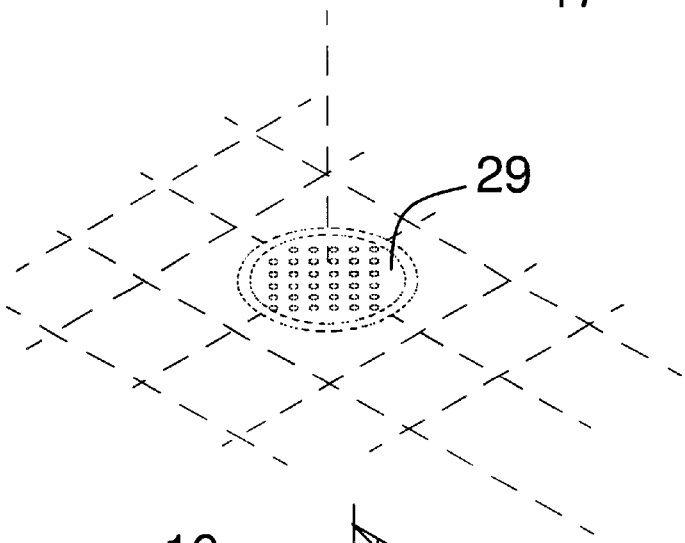
FIG. 2 is a bottom perspective view of the present invention.
Figure 2:
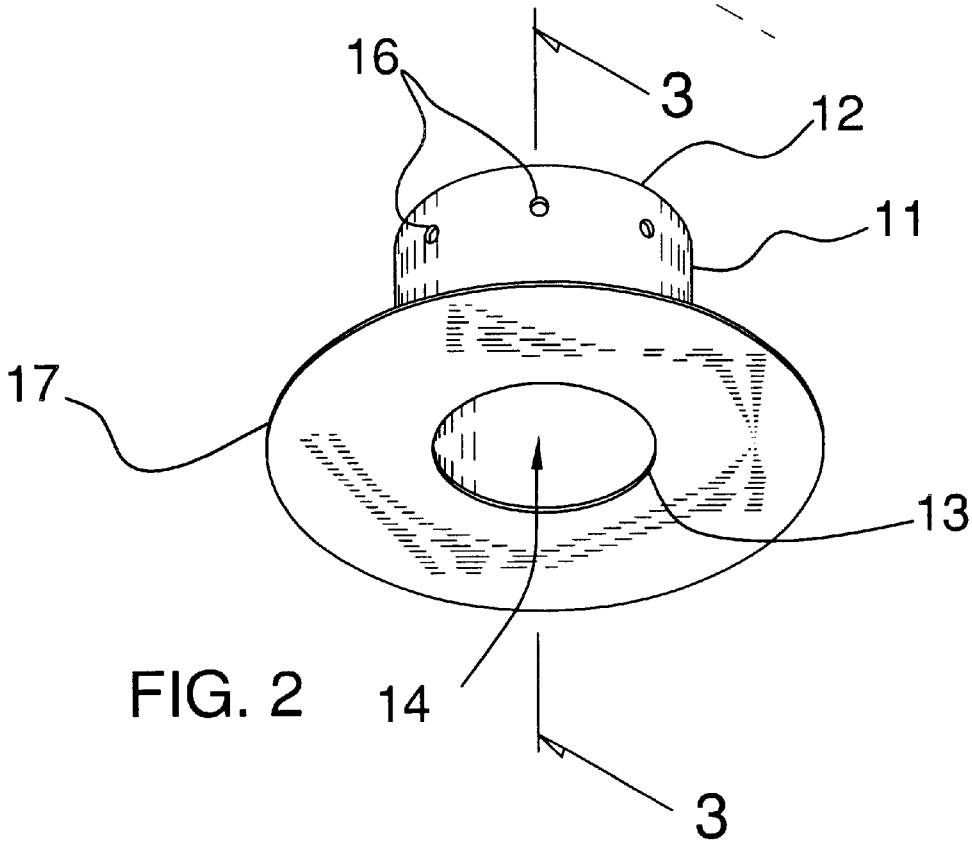
Figure 5:
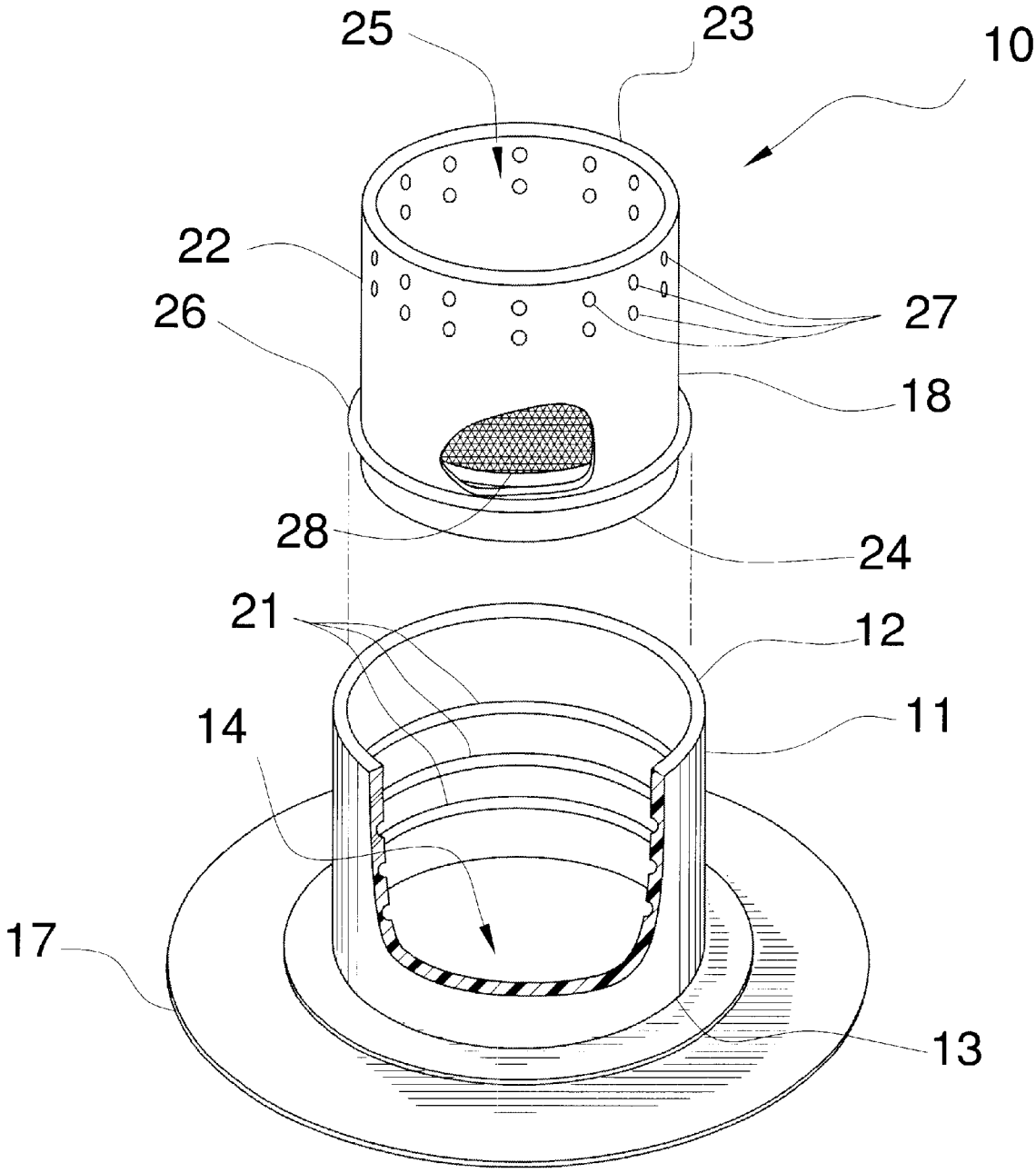
FIG. 5 is an exploded top perspective view of a second embodiment of the present invention.

With reference now to the drawings, and in particular to FIGS. 1 through 5 thereof, a new drain stopper to soak feet in a tub and shower embodying the principles and concepts of the present invention and generally designated by the reference numeral 10 will be described.

As best illustrated in FIGS. 1 through 5, the drain stopper to soak feet in a tub and shower 10 generally comprises a main tubular member 11 having open top 12 and bottom 13 ends and a bore 14 extending therethrough for removably mounting upon a drain 29 of a tub and shower with the main tubular member 11 having a length of approximately 2½ inches.

An annular flange member 17 is securely and conventionally attached at the bottom end 13 of the main tubular member 11 for plugging the drain 29 about a perimeter of the main tubular member 11. The flange member 17 is made of essentially rubber and has a diameter of approximately 5 inches.

A sieve member 18 is removably disposed in the bore 14 of the main tubular member 11 to effectively screen out particulate matter.

As a first embodiment, the main tubular member 11 includes a ledge 15 securely and conventionally disposed upon a wall defining the bore 14 of the main tubular member 11 with the ledge 15 extending about a circumference of the bore 14 and being disposed intermediate of the ends 12,13 thereof. The main tubular member 11 includes a plurality of holes 16 being spaced apart about the circumference thereof and extending through the wall near the top end 12 thereof to allow water in the tub and shower to flow therethrough. The sieve member 18 is essentially a screen 19 having a circular rim 20 which is removably supported upon the ledge 15 within the bore 14 of the main tubular member 11.

As a second embodiment, the main tubular member 11 includes a plurality of grooves 21 being spaced apart and extending in a wall defining the bore 14 of the main tubular member 11 and extending circumferentially about the bore 14. The sieve member 18 includes a second tubular member 22 having open top 23 and bottom 24 ends and also having a bore 25 extending therethrough and being adapted to extend in the bore 14 of the main tubular member 11 and having a ledge 26 conventionally disposed upon an exterior of the wall and extending about an outer circumference of the second tubular member 22 and being disposed near the bottom end 24 of the second tubular member 22, and further includes a screen 28 being securely and conventionally disposed in the bore 25 near the bottom end 24 of the second tubular member 22. The second tubular member 22 includes a plurality of holes 27 being spaced apart about the circumference thereof and extending through the wall near the top end 23 thereof to allow water in the tub and shower to flow therethrough with the holes 27 in the second tubular member 22 being arranged in rows which are spaced apart from one another.

In use, the user places the drain stopper 10 upon a drain 29 in a tub or shower and secures the sieve member 18 to the main tubular member 11 and then while the user is showering, the water from the shower fills the basin of the shower or tub to approximately 2½ inches to essentially soak the user's feet.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A drain stopper to soak feet in a tub and shower comprising:

a main tubular member having open top and bottom ends and a bore extending therethrough for removably mounting upon a drain of a tub and shower, said main tubular member having a length of approximately 2½ inches;

an annular flange member securely attached at said bottom end of said main tubular member for plugging the drain about a perimeter of said main tubular member, said flange member being made of essentially rubber said flange member having a diameter of approximately 5 inches; and a sieve member removably disposed in said bore of said main tubular member to effectively screen out particulate matter;

wherein said main tubular member includes an annular support ledge mounted on a wall defining said bore of said main tubular member, said annular support ledge being disposed intermediate of said ends of said main tubular member, said annular support ledge extending along a circumference of said bore and extending inwardly from said wall into said bore for supporting a periphery of said sieve member, said annular support ledge having an inner edge defining a circular opening therethrough such that said annular support ledge does not obstruct flow through said sieve member;

wherein said main tubular member includes a plurality of holes being spaced apart about the circumference thereof and extending through said wall near said top end thereof to allow water in the tub and shower to flow therethrough;

wherein said sieve member includes a screen having a circular rim which is removably supported upon said ledge within said bore of said tubular member.

* * * * *